US007333101B2

(12) United States Patent
Bu et al.

(10) Patent No.: US 7,333,101 B2
(45) Date of Patent: Feb. 19, 2008

(54) SYSTEMS AND DEVICES FOR DISPLAY IN WHICH FRAMES ARE DIVIDED INTO SUBFRAMES AND ASSIGNED DRIVING SHIFT VOLTAGES

(75) Inventors: Lin-Kai Bu, Tainan (TW); Li-Yi Chen, Nantou (TW)

(73) Assignee: Chi Mei Optoelectronics Corp., Shanhua Township (TW)

( * ) Notice: Subject to any disclaimer, the term of this patent is extended or adjusted under 35 U.S.C. 154(b) by 555 days.

(21) Appl. No.: 11/034,918

(22) Filed: Jan. 14, 2005

(65) Prior Publication Data

US 2005/0162416 A1 Jul. 28, 2005

Related U.S. Application Data

(63) Continuation of application No. 10/124,487, filed on Apr. 18, 2002, now Pat. No. 6,870,530.

(30) Foreign Application Priority Data

May 21, 2001 (TW) ..... 90112165 A

(51) Int. Cl.
*G09G 3/36* (2006.01)
*G09G 5/00* (2006.01)

(52) U.S. Cl. ..... 345/208; 345/94; 345/95

(58) Field of Classification Search ..... 345/55–100, 345/204–214

See application file for complete search history.

(56) References Cited

U.S. PATENT DOCUMENTS

| | | | | |
|---|---|---|---|---|
| 6,011,606 | A | 1/2000 | Ohe et al. | |
| 6,046,716 | A | 4/2000 | McKnight | |
| 6,157,356 | A * | 12/2000 | Troutman | 345/82 |
| 6,215,466 | B1 | 4/2001 | Yamazaki et al. | |
| 6,423,385 | B1 | 7/2002 | Kagawa et al. | |
| 6,587,084 | B1 * | 7/2003 | Alymov et al. | 345/60 |

* cited by examiner

*Primary Examiner*—David L. Lewis
(74) *Attorney, Agent, or Firm*—Finnegan, Henderson, Farabow, Garrett & Dunner LLP

(57) ABSTRACT

Systems and devices for display by sub-frame driving on a display. The display has pixels arranged in an m*n array, m and n are integers. The display receives a frame signal for displaying a frame for a frame period. The frame signal includes the pixel data for each of the pixels of the display. The frame period being divided into k sub-frame periods, a sub-frame being displayed during each of the sub-frame period. Each of the sub-frames corresponds to a driving shift, the system or device displays the sub-frames sequentially, wherein, the system or device components for displaying the pixel (i,j) of the p-th sub-frame includes components for applying a driving voltage (i,j) to the pixel (i,j). The driving voltage (i,j) is a target driving voltage corresponding to the pixel (i,j) plus the corresponding driving shift.

36 Claims, 7 Drawing Sheets

SYSTEMS AND DEVICES FOR DISPLAY IN WHICH FRAMES ARE DIVIDED INTO SUBFRAMES AND ASSIGNED DRIVING SHIFT VOLTAGES

This is a continuation of application Ser. No. 10/124,487, filed 18 Apr. 2002, now U.S. Pat. No. 6,870,530 and claims the benefit of Taiwan application Serial No. 90112165, filed May 21, 2001, both of which are incorporated herein by reference.

BACKGROUND OF THE INVENTION

1. Field of the Invention

The invention relates in general to the method of display by sub-frame driving, and more particularly to the method of display on a monitor by sub-frame driving.

2. Description of the Related Art

With the improvement and innovation of science and technology, the development of display technology changes rapidly and makes progress at a tremendous pace. The traditional CRT (Cathode Ray Tube) display has gradually dropped out the display market due to its large volume and serious radiation and is gradually replaced by LCD (Liquid Crystal Display), OLED (Organic Light Emitter Diode), or PDP (Plasma Display Panel), which are thin and have low radiation, low power consumption.

The frame data input to the display has two parts—pixel data and display timings. A driving voltage is determined according to the pixel data, and then the brightness of a pixel is determined according to the driving voltage. In addition to the pixel data, the frame data include a set of display timings, which have three parameters. The three parameters are Hs (Horizontal Synchronal signal), Vs (Vertical Synchronal signal), and CK (pixel clock). CK (pixel clock) represents the number of the pixels per second, which determines the interval between the action of displaying colors of some pixel and that of the next pixel. When the pixel corresponding to the input pixel data is the last pixel in a row, Hs (Horizontal Synchronous signal) controls to display the first pixel in the next row. Therefore, Hs (Horizontal Synchronous signal) determines the number of the rows per second. When the pixel corresponding to the input pixel data is the pixel of the last column of the last row in the screen, Vs (Vertical Synchronous signal) controls to display the first pixel of the first row. Therefore, Vs (Vertical Synchronous signal) determines the number of the displayed frames per second.

Take an LCD monitor for example. The transparency of each pixel is changed according to the driving voltage Vd applied, and accordingly the brightness of the pixel is determined. According to the pixel data, a target driving voltage $V_D$ is determined to let the pixel achieve a target transparency $T_D$. When the driving voltage Vd rises to the target driving voltage $V_D$, the transparency of the pixel cannot achieve the target transparency $T_D$ in real time due to the slow response of the liquid crystal in the pixel of the LCD monitor. FIG. 1A is a diagram of the driving voltage Vd of the pixel (i,j) vs. time. Pixel (i,j) is one of the pixels in the LCD monitor. The driving voltage Vd reaches the target driving voltage $V_D$ in a short time. FIG. 1B is a diagram of the transparency of the pixel (i,j) vs. time. When the driving voltage Vd is applied to the pixel (i,j), the transparency of the pixel (i,j) rises accordingly. But the transparency of the pixel (i,j) takes a longer period t1 to reach the target transparency $T_D$.

A well-known method to speed up the response of the liquid crystal is to apply an over-drive voltage Vo, which is higher in magnitude than the desired target driving voltage $V_D$. FIG. 2A is a diagram of the driving voltage Vd vs. time using the over-drive method. First, the driving voltage Vd rises to the over-drive voltage Vo for speeding up the response of the liquid crystal in pixel (i,j). FIG. 2B is a diagram of the transparency of the pixel (i,j) vs. time according to the driving voltage Vd shown in FIG. 2A. The transparency of the pixel (i,j) reaches the target transparency $T_D$ faster than that shown in FIG. 1B.

However, it is not easy to control the magnitude of the over-drive voltage Vo. If the over-drive voltage Vo is too high, the transparency may exceed the target transparency $T_D$; if the over-drive voltage Vo is too low, the response of the liquid crystal may not be fast enough.

SUMMARY OF THE INVENTION

It is therefore an object of the invention to provide a method of driving pixels to shorten the response time thereof.

The invention achieves the above-identified objects by providing a method of display by sub-frame driving on a monitor. The monitor has pixels arranged in an m*n array, where m and n are integers. The monitor receives a frame signal for displaying a frame for a frame period. The frame signal includes the pixel data for each of the pixels of the monitor. The frame period is divided into a first sub-frame period and a second sub-frame period. A first sub frame is displayed during the first sub-frame period, and a second sub frame is displayed during the second sub-frame period. The first sub frame corresponds to a first driving voltage, and the second sub frame corresponds to a second driving voltage. The first driving voltage and the second driving voltage for the pixel (i,j) are unequal, wherein $0<i\leqq m$, $0<j\leqq n$, i, and j are integers. The method comprises the steps of displaying the first sub-frame according to the first driving voltage and displaying the second sub-frame according to the second driving voltage.

Other objects, features, and advantages of the invention will become apparent from the following detailed description of the preferred but non-limiting embodiments. The following description is made with reference to the accompanying drawings.

DETAILED DESCRIPTION OF THE INVENTION

The method of display by sub-frame driving according to this invention is used for displaying frames on a monitor. The monitor has pixels arranged in an m*n array, where m and n are integers. The monitor receives a frame signal for displaying a frame for a frame period. For example, if the refresh rate of the monitor is 60 Hz, the frame period is 1/60 second. The frame signal includes the pixel data for each of the pixels of the monitor. In this invention, the frame period is divided into k sub-frame periods, and a sub frame is displayed during each of the sub-frame period. In other words, a frame is displayed during k steps, and at each step a sub-frame is displayed for the corresponding sub-frame period. Each of the sub frames corresponds to a driving shift. Note that the sub-frame periods are not necessarily equal and k is an integer.

The preferred embodiment according to this invention takes LCD monitor for example. Each pixel of the LCD monitor includes liquid crystal, and the transparency of the liquid crystal is determined by a driving voltage. A frame period is divided into a first sub-frame period and a second sub-frame period. A frame is displayed in two steps: a first sub-frame is displayed during the first sub-frame period, and then a second sub-frame is displayed during the second sub-frame period. The first sub-frame corresponds to a first driving shift, and the second sub-frame corresponds to a second driving shift.

The method of displaying a frame by sub-frame driving includes the following steps. First, display the first sub frame for the first sub-frame period at time ts0. Then display the second sub frame for the second sub-frame period at time ts1.

While the first sub frame is displayed, the driving voltage is the over-drive voltage Vo generated from the target driving voltage $V_D$, derived from the pixel data, plus the first driving shift. The first driving shift is larger than zero, and thus speeds up the response of the liquid crystal. While the second sub frame is displayed, the driving voltage is the target driving voltage $V_D$, derived from the pixel data, plus the second driving shift. The second driving shift is zero in this embodiment for maintaining the transparency of the liquid crystal at the target transparency $T_D$.

Figure 1A:
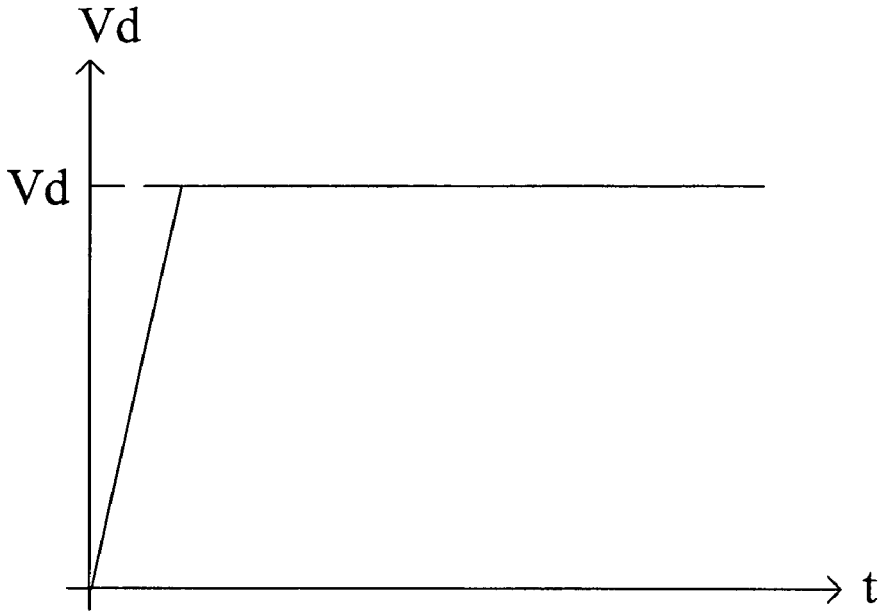
FIG. 1A (PRIOR ART)
FIG. 1A is a diagram of the driving voltage Vd of the pixel (i,j) vs. time.
Figure 1B:
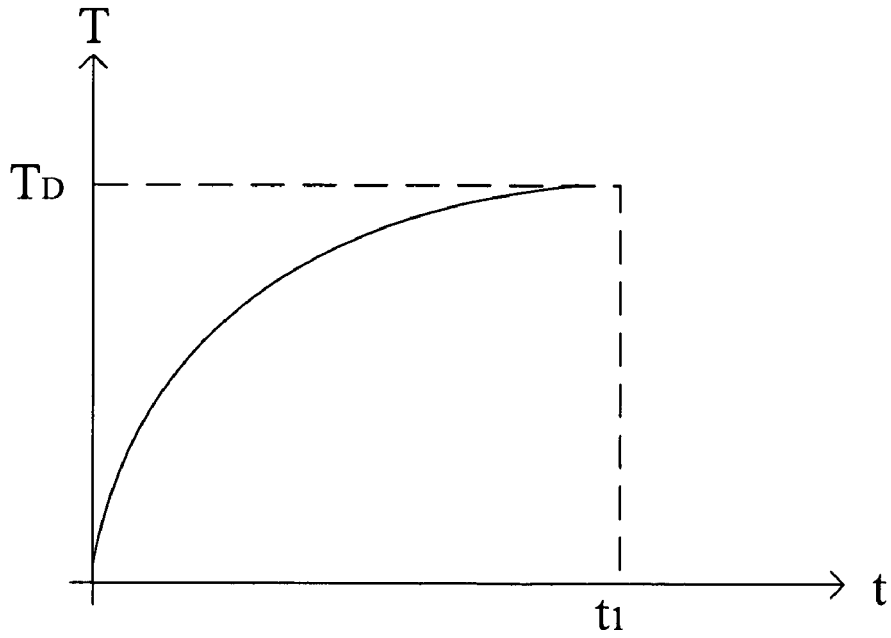
FIG. 1B (PRIOR ART)
FIG. 1B is a diagram of the transparency of the pixel vs. time.
Figure 2A:
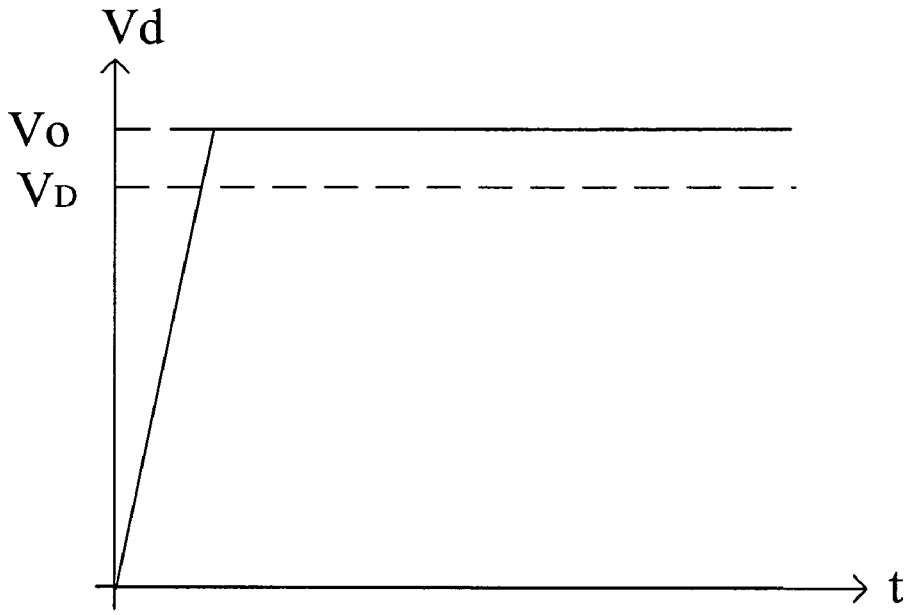
FIG. 2A (PRIOR ART)
FIG. 2A is a diagram of the driving voltage vs. time using the over-drive method.
Figure 2B:
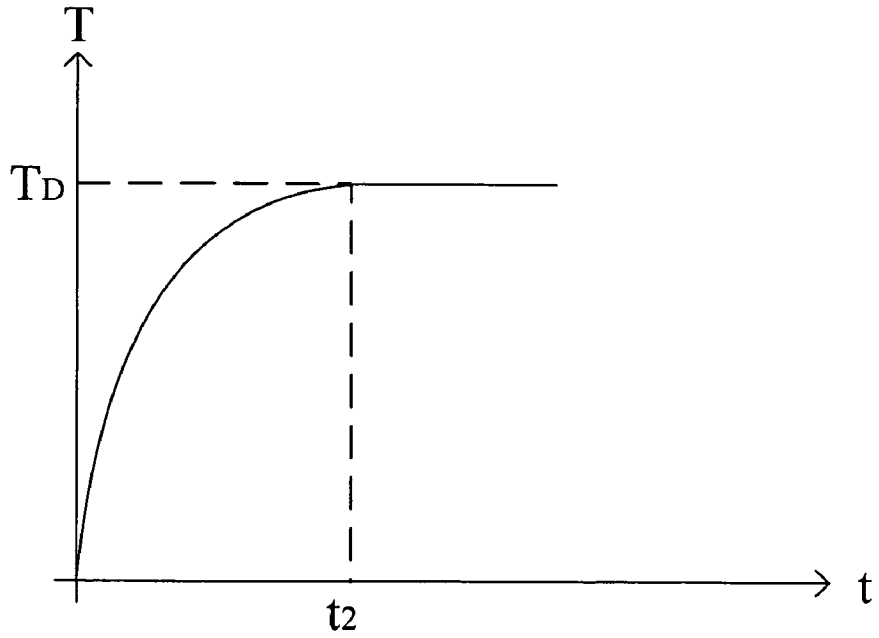
FIG. 2B (PRIOR ART)
FIG. 2B is a diagram of the transparency of the pixel vs. time according to the driving voltage shown in FIG. 2A.
Figure 3A:
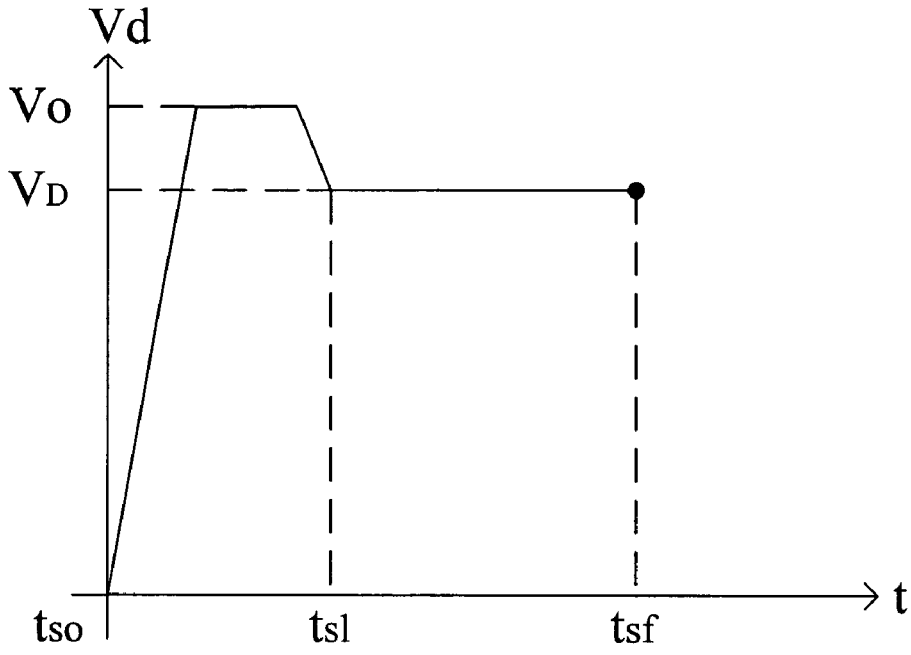
FIG. 3A is a diagram of the driving voltage for the pixel according to this embodiment.
Figure 3B:
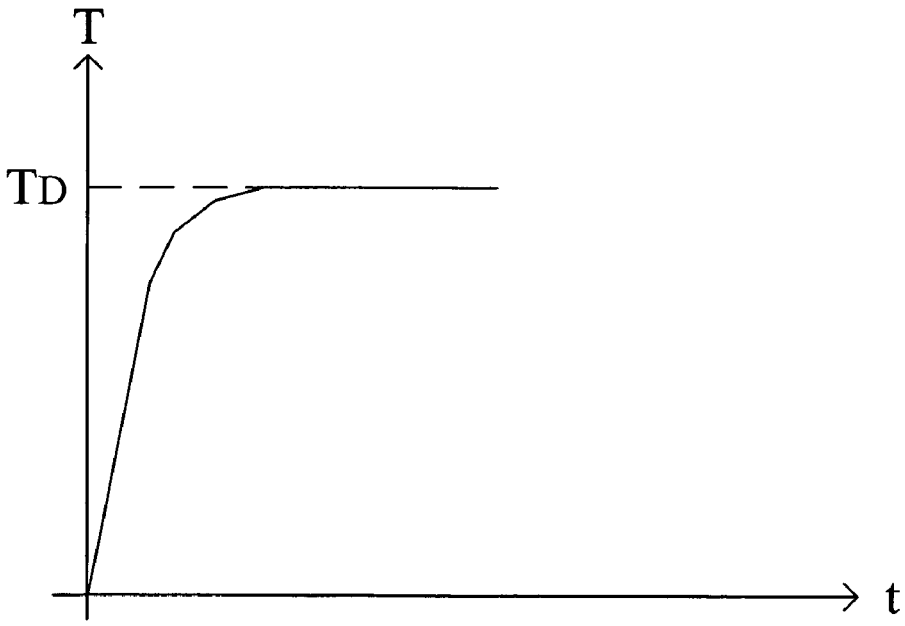
FIG. 3B is a diagram of the transparency for the pixel.

FIG. 3A is a diagram of the driving voltage Vd(i,j) for the pixel (i,j) according to this embodiment. FIG. 3B is a diagram of the transparency for pixel (i,j). At time ts0, display the first sub frame by inputting the overdrive voltage Vo to the pixel (i,j) to speed up the response of the liquid crystal. Then, at time ts1, display the second sub frame by inputting the driving voltage Vd to pixel (i,j). Because the second driving shift is zero, the driving voltage Vd is equal to the target driving voltage $V_D$ for maintaining the transparency of the pixel (i,j) at the target transparency $T_D$.

Figure 4A:
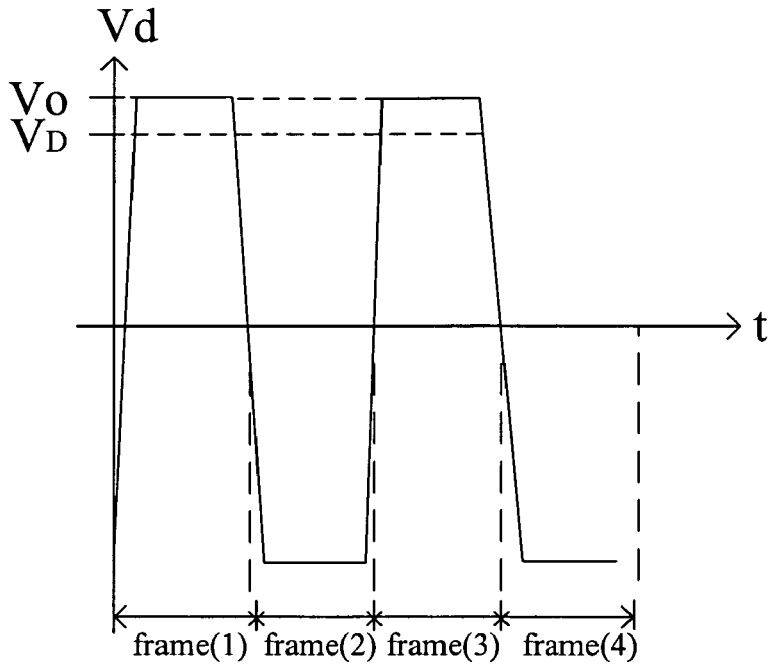
FIG. 4A (PRIOR ART)
FIG. 4A is a diagram of the driving voltage for the pixel according to the traditional method of over driving.
Figure 4B:
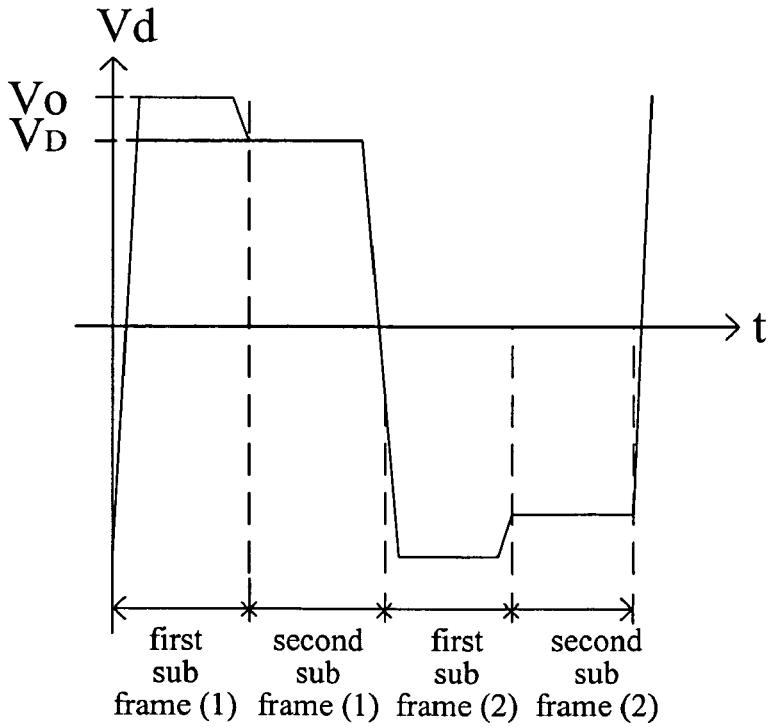
FIG. 4B is a diagram of the driving voltage for the pixel according to the first embodiment.

FIG. 4A is a diagram of the driving voltage for pixel (i,j) according to the traditional method of over driving. Polarization switch is needed when a frame is switched to another, which is well known. The refresh rate should be doubled if the traditional over driving method is adopted for better performance. FIG. 4B is a diagram of the driving voltage Vd for pixel (i,j) according to the first embodiment. The driving voltages for sub frames of the same frame are of the same polarity. The refresh rate of the embodiment is the same as that of the traditional over driving method. However, the number of polarity switching is less than that of the traditional over driving method. Accordingly, the power consumption is reduced.

The above-mentioned embodiment controls the magnitude of the first sub-frame period and the first driving shift to speed up the response time, and then maintain the target transparency during the second sub-frame period. Accordingly, the control is simpler.

Figure 5A:
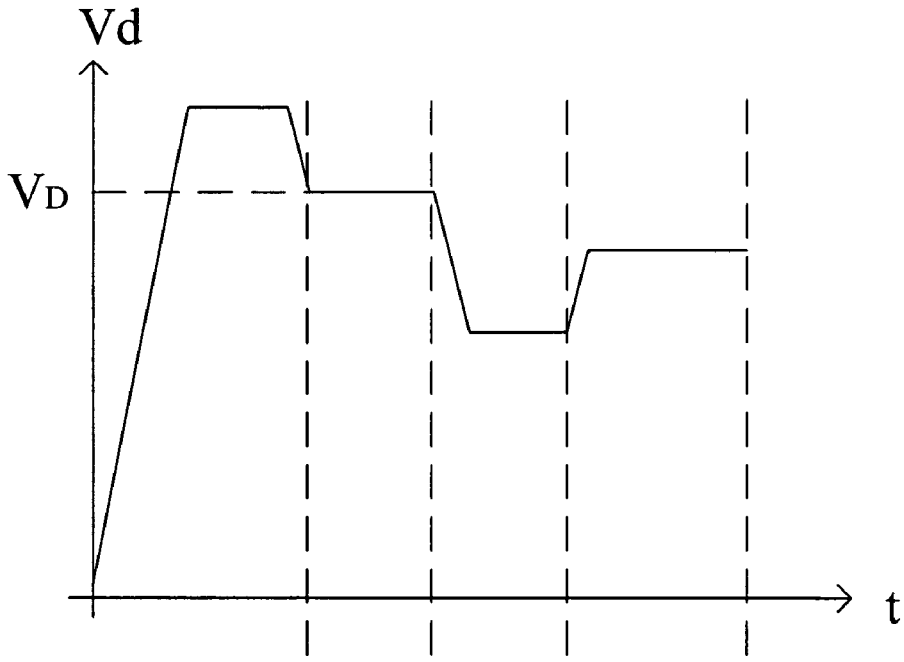
FIG. 5A is a diagram of the driving voltages for four sub frames per frame according to another embodiment of this invention.
Figure 5B:
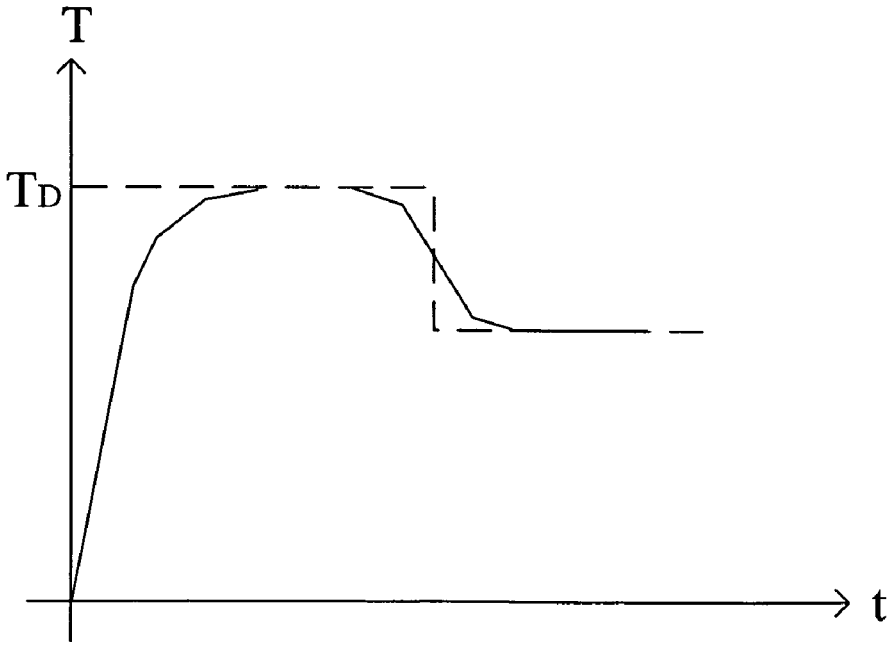
FIG. 5B is a diagram of the transparency by the driving voltages shown in FIG. 5A.

The invention is not limited to the two sub frames for a frame. More sub frames for a frame can be used. FIG. 5A is a diagram of the driving voltage for four sub frames per frame according to another embodiment of this invention. Refer to FIG. 5B at the same time. FIG. 5B is a diagram of the transparency by the driving voltages shown in FIG. 5A. This embodiment has the ability to process light signals. The monitors have two categories: impulse type and hold type. The CRT monitor is an example of the impulse type monitor. The LCD, OLED, and PDP are examples of the hold type monitor. The impulse type monitor utilizes electron beam to hit on the screen. The hitted pixel is bright, while the un-hitted pixels are dark. The pixels of the hold type monitor remain the brightness according to the inputted pixel data. The image quality of the hold type monitor is not as good as that of the impulse type monitor, because the high-frequency part of the image on the hold type monitor is less. The driving voltages shown in FIG. 5A can compensate the high-frequency part to enhance the image quality.

The invention displays one frame at several steps. A sub frame is displayed during each step. Although the refresh rate increases if the number of the sub frames per frame increases, the polarity of the driving voltage for the sub frames of a frame remain the same. Accordingly, the power is saved.

Figure 6:
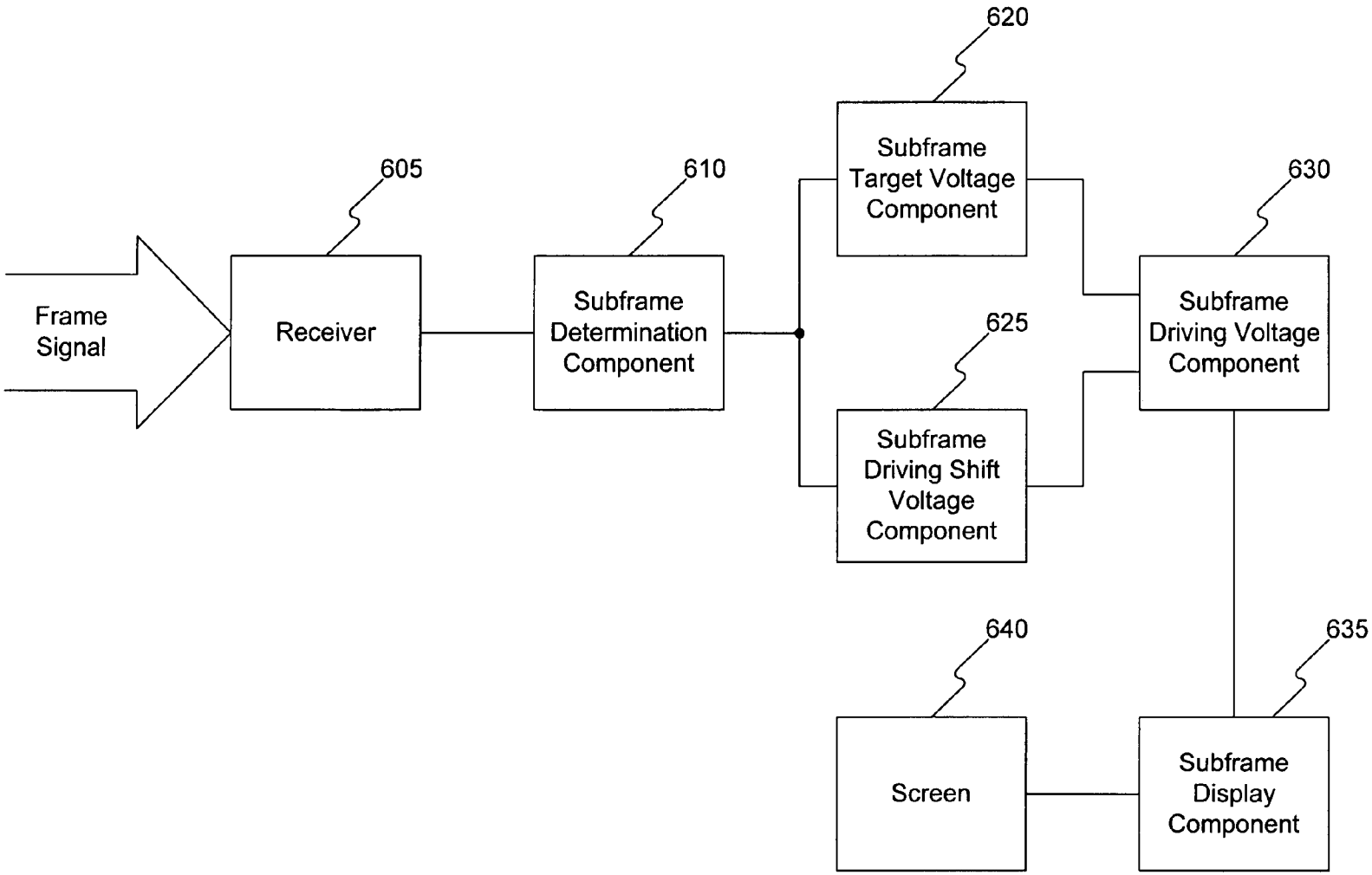
FIG. 6 is a block diagram of an exemplary device for driving a display, consistent with the invention.

FIG. 6 is a block diagram of an exemplary device for driving a display, consistent with the invention. As shown, the device includes a receiver component 605 that receives a frame signal containing information for displaying a frame for a frame period. The frame signal includes pixel data for each of the pixels of the frame to be displayed, for example, on a display including pixels (i,j) that are arranged in an m*n array, where i, j, m and n are integers. As is known in the art, the frame signal may be analog, such as would be received over a VGA (video graphics array) connection, or digital, such as would be received over a DVI (digital video interface) connection. In one embodiment, receiver component 605 converts a received analog frame signal into corresponding digital data for processing by other components.

Receiver component 605 is connected to a sub-frame determination component 610. Sub-frame determination component 610 divides the frame represented by the frame signal into a sequence of k sub-frames and the frame period into a sequence of k sub-frame periods. The parameter k is an integer, and in one embodiment, k=2. The sub-frame periods are not necessarily equal, though they may be.

Sub-frame determination component 610 is connected to a sub-frame target voltage component 620 and a sub-frame driving shift voltage component 625. Sub-frame target voltage component 620 determines a target driving voltage corresponding to the pixel data from the frame signal for each of the pixels (i,j) in a frame, and sub-frame driving shift voltage component 625 determines a driving shift voltage corresponding to each of the sub-frames for a frame. As explained above, the determined driving shift voltage may be a voltage that, when added to the target driving voltage, results in an overdrive voltage for the pixel. Also as explained above, the determined driving shift voltage may be zero.

Sub-frame target voltage component 620 and sub-frame driving shift voltage component 625 are connected to a sub-frame driving voltage component 630. Sub-frame driving voltage component 630 determines the driving voltage for each pixel(i,j) in a sub-frame based on the target driving voltage corresponding to the pixel data for each of the pixels (i,j) in a frame and the driving shift voltage corresponding to each of the sub-frames for a frame. In one embodiment, the driving voltage (i,j) is determined by adding the target driving voltage corresponding to the pixel data with the driving shift voltage corresponding to the sub-frame. The determined driving voltages for a given pixel (i,j) in two different sub-frames may be of the same polarity.

Sub-frame driving voltage component 630 is connected to a sub-frame display component 635, which is connected to a screen 640, such as an LCD screen, an OLED screen, or a PDP screen. Sub-frame display component 635 provides a signal for continuously displaying pixel data during the sequence of sub-frames for a frame, by applying the driving voltage (i,j) (determined by sub-frame driving voltage component 630) to each pixel (i,j) during the sequence of sub-frames that make up a frame. For example, if there are two subframes for a frame, sub-frame display component 635 provides a signal for continuously displaying pixel data for the first sub-frame during the first sub-frame period, then provides a signal for continuously displaying pixel data for the second sub-frame during the second sub-frame period. As is known in the art, the signal for displaying pixel data is typically an analog signal that may be produced by a DAC (digital-to-analog converter), an amplifier, or some combination of circuit elements.

Figure 7:
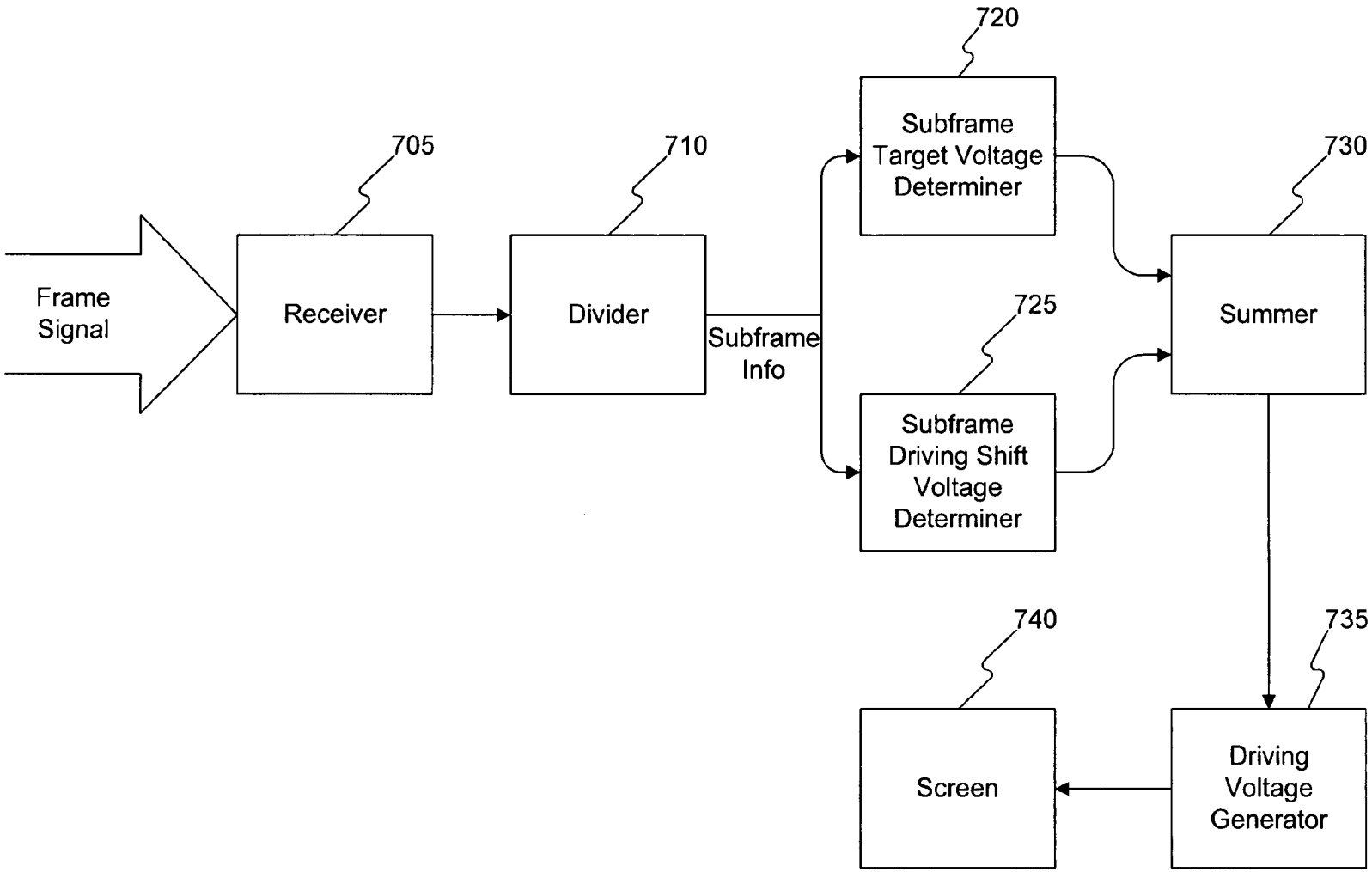
FIG. 7 is a block diagram of an exemplary system for driving a display, consistent with the invention.

FIG. 7 is a block diagram of an exemplary system for driving a display, consistent with the invention. As shown, the system includes a receiver 705 that receives a frame signal containing information for displaying a frame for a frame period. The frame signal includes pixel data for each of the pixels of the frame to be displayed, for example, on a display including pixels (i,j) that are arranged in an m*n array, where i, j, m and n are integers and 0<i<=m, and 0<j<=n. As is known in the art, the frame signal may be analog, such as would be received over a VGA (video graphics array) connection, or digital, such as would be received over a DVI (digital video interface) connection. In one embodiment, receiver 705 converts a received analog frame signal into corresponding digital data before further processing.

Receiver 705 is connected to a divider 710. Divider 710 divides the frame represented by the frame signal into a sequence of k sub-frames and the frame period into a sequence of k sub-frame periods. The parameter k is an integer, and in one embodiment, k=2. The sub-frame periods are not necessarily equal, although they may be.

Divider 710 is connected to a sub-frame target voltage determiner 720 and a sub-frame driving shift voltage determiner 725. Sub-frame target voltage determiner 720 determines a target driving voltage corresponding to the pixel data from the frame signal for each of the pixels (i,j) in a frame, and sub-frame driving shift voltage determiner 725 determines a driving shift voltage corresponding to each of the sub-frames for the frame. As explained above, the determined driving shift voltage for a given pixel in a given sub-frame may be a voltage that, when added to the target driving voltage, results in an overdrive voltage for the pixel during the sub-frame's period. Furthermore, as also explained above, the determined driving shift voltage may be zero.

Sub-frame target voltage determiner 720 and sub-frame driving shift voltage determiner 725 are connected to a summer 730. Summer 730 determines the driving voltage for each pixel(i,j) in a sub-frame by adding the target driving voltage corresponding to the pixel data for each of the pixels (i,j) in a frame to the driving shift voltage corresponding to each of the sub-frames for a frame. The driving voltages output by summer 730 for a given pixel (i,j) in two different sub-frames may be of the same polarity.

Summer 730 is connected to a driving voltage generator 735, which is connected to a screen 740, such as an LCD screen, an OLED screen, or a PDP screen. Driving voltage generator 735 provides a signal for continuously displaying pixel data during the sequence of sub-frames for a frame, by supplying the driving voltage (i,j) (determined by summer 730) for each pixel (i,j) during the sequence of sub-frames that make up a frame. For example, if there are two subframes for a frame, driving voltage generator 735 generates a signal for continuously displaying pixel data for the first sub-frame during the first sub-frame period, then generates a signal for continuously displaying pixel data for the second sub-frame during the second sub-frame period. As is known in the art, the signal for displaying pixel data is typically an analog signal that may be produced by a DAC (digital-to-analog converter), an amplifier, or some combination of circuit elements.

As is known in the art, the exemplary devices, components, systems, and subsystems illustrated may be implemented in hardware, software, or a combination thereof. Furthermore, one of ordinary skill will now recognize that the exemplary devices, components, systems, and subsystems depicted may have parts added, deleted, replaced, or connected differently, yet remain within the scope of the invention.

While the invention has been described by way of example and in terms of a preferred embodiment, it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. A device for driving a display having pixels (i,j) arranged in an m*n array, i, j, m and n being integers, comprising:

a receiver for receiving a frame signal for displaying a frame for a frame period, the frame signal including the pixel data for each of the pixels of the display screen;

a sub-frame determination component, connected to the receiver, for dividing the frame into a sequence of k sub-frames and the frame period into a sequence of k sub-frame periods;

a sub-frame target voltage component, connected to the sub-frame determination component, for determining a target driving voltage corresponding to the pixel data for a pixel (i,j);

a sub-frame driving shift voltage component, connected to the sub-frame determination component, for determining a driving shift voltage corresponding to a p-th sub-frame of the sequence of k sub-frames;

a sub-frame driving voltage component, connected to the sub-frame target voltage component and the sub-frame driving shift voltage component, for determining a driving voltage (i,j) corresponding to the pixel (i,j) based on the target driving voltage and the driving shift voltage;

a sub-frame display component, connected to the sub-frame driving voltage component, for applying a driving voltage (i,j) to each pixel (i,j) of the p-th sub-frame; and a screen, connected to the sub-frame display component, for displaying the pixel data continuously during the sequence of sub-frames according to the driving voltage;

wherein $1 \leqq p \leqq k$, $0 \leqq i < m$, $0 < j \leqq n$, and p and k are integers.

2. The device according to claim 1, wherein the driving voltages for the pixel (i,j) at each of the k sub-frames are of the same polarity.

3. The device according to claim 1, wherein k is set to 2.

4. The device according to claim 1, wherein the sub-frame periods are unequal.

5. The device according to claim 1, wherein the display is an LCD (Liquid Crystal Display).

6. The device according to claim 1, wherein the display is an OLED (Organic Light Emitter Diode) display.

7. The device according to claim 1, wherein the display is a PDP (Plasma Display Panel).

8. A device for driving a display having pixels (i,j) arranged in an m*n array, i,j, m and n being integers, comprising:

a receiver for receiving a frame signal for displaying a frame for a frame period, the frame signal including pixel data for each of the pixels of the display;

a sub-frame determination component, connected to the receiver, for dividing the frame period into a first sub-frame period and a second sub-frame period, a first sub-frame being displayed during the first sub-frame period, and a second sub-frame being displayed during the second sub-frame period;

a sub-frame target voltage component, connected to the sub-frame determination component, for determining a target driving voltage corresponding to the pixel data for a pixel (i,j), wherein $0 < i \leqq m$, $0 < j \leqq n$;

a sub-frame driving shift voltage component, connected to the sub-frame determination component, for determining a first driving shift voltage assigned to the first sub-frame and for determining a second driving shift voltage assigned to the second sub-frame;

a sub-frame driving voltage component, connected to the sub-frame target voltage component and the sub-frame driving shift voltage component, for determining a first driving voltage (i,j) for each pixel (i,j) for the first sub-frame by adding the target driving voltage and the first driving shift voltage, and for determining a second driving voltage (i,j) for each pixel (i,j) for the second sub-frame by adding the target driving voltage and the second driving shift voltage;

a sub-frame display component, connected to the sub-frame driving voltage component, for applying the first driving voltage (i,j) to each pixel (i,j) of the first sub-frame and for applying the second driving voltage (i,j) to each pixel (i,j) of the second sub-frame; and a screen, connected to the sub-frame display component, for continuously displaying the pixel data during the first and second sub-frames.

9. The device according to claim 8, wherein the driving voltages for the pixel (i,j) at the first and second sub-frames are of the same polarity.

10. The device according to claim 8, wherein the sub-frame periods are unequal.

11. The device according to claim 8, wherein the display is an LCD (Liquid Crystal Display).

12. The device according to claim 8, wherein the display is an OLED (Organic Light Emitter Diode) display.

13. The device according to claim 8, wherein the display is a PDP (Plasma Display Panel).

14. A device for driving a display having pixels arranged in an m*n array, m and n being integers comprising:

a receiver for receiving a frame signal for displaying a frame for a frame period, the frame signal including pixel data for each of the pixels of the display;

a sub-frame determination component, connected to the receiver, for dividing the frame period into a first sub-frame period and a second sub-frame period;

a sub-frame driving shift voltage component, connected to the sub-frame determination component, for assigning a first driving shift voltage to a first sub-frame and for assigning a second driving shift voltage to a second sub-frame, wherein the first driving shift voltage and the second driving shift voltage for the pixel (i,j) are unequal;

a sub-frame display component, connected to the sub-frame driving shift voltage component and connected to a screen, for displaying the pixel data during the first sub-frame according to the first driving shift voltage and displaying the pixel data during the second sub-frame according to the second driving shift voltage, wherein the pixel data is displayed continuously on the screen during the first and second sub-frames.

15. The device according to claim 14, wherein the first sub-frame period and the second sub-frame period are unequal.

16. The device according to claim 14, wherein the display is an LCD (Liquid Crystal Display).

17. The device according to claim 14, wherein the display is an OLED (Organic Light Emitter Diode) display.

18. The device according to claim 14, wherein the display is a PDP (Plasma Display Panel).

19. A system for driving a display having pixels (i,j) arranged in an m*n array, i, j, m and n being integers, comprising:

a receiver for receiving a frame signal for displaying a frame for a frame period, the frame signal including the pixel data for each of the pixels of the display screen;

a divider, connected to the receiver, for dividing the frame into a sequence of k sub-frames and the frame period into a sequence of k sub-frame periods;

a sub-frame target voltage determiner, connected to the divider, for determining a target driving voltage corresponding to the pixel data for a pixel (i,j);

a sub-frame driving shift voltage determiner, connected to the divider, for determining a driving shift voltage corresponding to a p-th sub-frame of the sequence of k sub-frames;

a summer, connected to the sub-frame target voltage determiner and the sub-frame driving shift voltage determiner, for determining a driving voltage (i,j) corresponding to the pixel (i,j) by adding the target driving voltage and the driving shift voltage;

a driving voltage generator, connected to the summer, for applying a driving voltage (i,j) to each pixel (i,j) of the p-th sub-frame; and a screen, connected to the driving voltage generator, for displaying the pixel data continuously during the sequence of sub-frames according to the driving voltage;

wherein $1 \leqq p \leqq k$, $0<i \leqq m$, $0<j \leqq n$, and p and k are integers.

20. The system according to claim 19, wherein the driving voltages for the pixel (i,j) at each of the k sub-frames are of the same polarity.

21. The system according to claim 19, wherein k is set to 2.

22. The system according to claim 19, wherein the sub-frame periods are unequal.

23. The system according to claim 19, wherein the display is an LCD (Liquid Crystal Display).

24. The system according to claim 19, wherein the display is an OLED (Organic Light Emitter Diode) display.

25. The system according to claim 19, wherein the display is a PDP (Plasma Display Panel).

26. A system for driving a display having pixels (i,j) arranged in an m*n array, i, j, m and n being integers, comprising:

a receiver for receiving a frame signal for displaying a frame for a frame period, the frame signal including pixel data for each of the pixels of the display;

a divider, connected to the receiver, for dividing the frame period into a first sub-frame period and a second sub-frame period, a first sub-frame being displayed during the first sub-frame period, and a second sub-frame being displayed during the second sub-frame period;

a sub-frame target voltage determiner, connected to the divider, for determining a target driving voltage corresponding to the pixel data for a pixel (i,j), wherein $0<i \leqq m$, $0<j \leqq n$;

a sub-frame driving shift voltage determiner, connected to the divider, for determining a first driving shift voltage assigned to the first sub-frame and for determining a second driving shift voltage assigned to the second sub-frame;

a summer, connected to the sub-frame target voltage determiner and the sub-frame driving shift voltage determiner, for determining a first driving voltage (i,j) for each pixel (i,j) for the first sub-frame by adding the target driving voltage and the first driving shift voltage, and for determining a second driving voltage (i,j) for each pixel (i,j) for the second sub-frame by adding the target driving voltage and the second driving shift voltage;

a driving voltage generator, connected to the summer, for applying the first driving voltage (i,j) to each pixel (i,j) of the first sub-frame and for applying the second driving voltage (i,j) to each pixel (i,j) of the second sub-frame; and a screen, connected to the driving voltage generator, for continuously displaying the pixel data during the first and second sub-frames.

27. The system according to claim 26, wherein the driving voltages for the pixel (i,j) at the first and second sub-frames are of the same polarity.

28. The system according to claim 26, wherein the sub-frame periods are unequal.

29. The system according to claim 26, wherein the display is an LCD (Liquid Crystal Display).

30. The system according to claim 26, wherein the display is an OLED (Organic Light Emitter Diode) display.

31. The system according to claim 26, wherein the display is a PDP (Plasma Display Panel).

32. A system for driving a display having pixels arranged in an m*n array, m and n being integers comprising:

a receiver for receiving a frame signal for displaying a frame for a frame period, the frame signal including pixel data for each of the pixels of the display;

a divider, connected to the receiver, for dividing the frame period into a first sub-frame period and a second sub-frame period;

a sub-frame driving shift voltage determiner, connected to the divider, for assigning a first driving shift voltage to a first sub-frame and for assigning a second driving shift voltage to a second sub-frame, wherein the first driving shift voltage and the second driving shift voltage for the pixel (i,j) are unequal;

a driving voltage generator, connected to the sub-frame driving shift voltage determiner and connected to a screen, for displaying the pixel data during the first sub-frame according to the first driving shift voltage and displaying the pixel data during the second sub-frame according to the second driving shift voltage, wherein the pixel data is displayed continuously on the screen during the first and second sub-frames.

33. The system according to claim 32, wherein the first sub-frame period and the second sub-frame period are unequal.

34. The system according to claim 32, wherein the display is an LCD (Liquid Crystal Display).

35. The system according to claim 32, wherein the display is an OLED (Organic Light Emitter Diode) display.

36. The system according to claim 32, wherein the display is a PDP (Plasma Display Panel).

* * * * *